US011001974B2

(12) United States Patent
Nagrodsky et al.

(10) Patent No.: US 11,001,974 B2
(45) Date of Patent: May 11, 2021

(54) INSULATING JOINT FOR ELECTRICALLY INSULATING A PAIR OF ADJACENT RAIL SECTIONS AND RAILWAY TRACK COMPRISING SUCH INSULATING JOINT

(71) Applicant: ALSTOM Transport Technologies, Saint-Ouen (FR)

(72) Inventors: Nicholas Nagrodsky, Melbourne, FL (US); Jared Cooper, Melbourne, FL (US)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 540 days.

(21) Appl. No.: 15/910,255

(22) Filed: Mar. 2, 2018

(65) Prior Publication Data

US 2019/0271118 A1 Sep. 5, 2019

(51) Int. Cl.
*E01B 11/54* (2006.01)
*E01B 29/42* (2006.01)

(52) U.S. Cl.
CPC ..... *E01B 11/54* (2013.01); *E01B 29/42* (2013.01); *E01B 2205/00* (2013.01)

(58) Field of Classification Search
CPC ..... E01B 11/0054; E01B 11/56; E01B 29/42; E01B 29/44; E01B 29/46; E01B 2205/00
See application file for complete search history.

(56) References Cited

U.S. PATENT DOCUMENTS

| | | | | |
|---|---|---|---|---|
| 2,130,106 | A * | 9/1938 | Schermerhorn | E01B 11/54 238/153 |
| 3,389,859 | A * | 6/1968 | Groff | E01B 11/54 238/152 |
| 4,466,570 | A * | 8/1984 | Howard | E01B 11/58 238/153 |
| 4,773,590 | A * | 9/1988 | Dash | E01B 11/54 238/153 |
| 2006/0243818 | A1* | 11/2006 | Urmson, Jr. | E01B 11/54 238/152 |
| 2007/0272762 | A1* | 11/2007 | Click | E01B 11/54 238/14.05 |
| 2010/0213269 | A1* | 8/2010 | Ciloglu | E01B 11/54 238/153 |
| 2019/0085513 | A1* | 3/2019 | Roy | E01B 11/54 |
| 2019/0271118 | A1* | 9/2019 | Nagrodsky | E01B 11/54 |

* cited by examiner

*Primary Examiner* — Jason C Smith
(74) *Attorney, Agent, or Firm* — Pearne & Gordon LLP

(57) ABSTRACT

The present invention concerns an insulating joint for electrically insulating a pair of adjacent rail sections of a railway track, each rail section extending along a longitudinal axis and defining at least one connecting surface substantially perpendicular to the longitudinal axis and a plurality of lateral surfaces extending along the longitudinal axis. The insulating joint comprises a joint body having substantially the same cross section as the rail sections and defining two contacting surfaces, each contacting surface being intended to be in contact with the connecting surface of one of the rail sections. The joint body is made from an insulating material comprising a reinforcing structure made of metal or carbon fibers, the reinforcing structure being placed inside of the joint body with a distance from the contacting surfaces.

19 Claims, 2 Drawing Sheets

INSULATING JOINT FOR ELECTRICALLY INSULATING A PAIR OF ADJACENT RAIL SECTIONS AND RAILWAY TRACK COMPRISING SUCH INSULATING JOINT

FIELD OF THE INVENTION

The present invention concerns an insulating joint for electrically insulating a pair of adjacent rail sections.

The present invention concerns also a railway track comprising such insulating joint.

BACKGROUND OF THE INVENTION

It is known that a railway track is generally divided in a plurality of rail sections adjacent one to another. Each rail section is electrically isolated from an adjacent section by an insulating joint that is usually glued in place between corresponding rail sections. This prevents data signals transmitted by the rail section from an uncontrolled propagation to the adjacent rail sections.

Notably, as it is known in the art, data signals transmitted by the rail sections make it possible to communicate between different kinds of installations disposed along the railway track in order to determine for example the exact train position on the track. So, it is important to assure the integrity of these signals notably by controlling their propagation along the railway track.

Different kinds of insulating joints for controlling the signal propagation are known in the art. These joints are typically made of polyurethane or other non-conductive materials such as epoxy resins.

Because of the nature of such material which is not as strong as the material of the rail itself, the insulating joints must be regularly replaced. The frequency of the replacement may vary between six months and eight years, depending of course on the frequency of the trains passage over the corresponding joint, weather conditions, etc.

It is clear that the replacement of the insulating joints presents an important cost of the maintenance process of railway tracks.

SUMMARY OF THE INVENTION

The aim of the present invention is to propose an insulating joint which makes it possible to reduce the cost of maintenance works. Particularly, the insulating joint according to the invention is stronger than a classical insulating joint so as its life cycle can be compared with the life cycle of the rail itself.

To this end, the object of the invention is to propose an insulating joint for electrically insulating a pair of adjacent rail sections of a railway track, each rail section extending along a longitudinal axis and defining at least one connecting surface substantially perpendicular to the longitudinal axis and a plurality of lateral surfaces extending along the longitudinal axis.

The insulating joint comprises a joint body having substantially the same cross section as the rail sections and defining two contacting surfaces, each contacting surface being intended to be in contact with the connecting surface of one of the rail sections.

The joint body is made from an insulating material comprising a reinforcing structure made of metal or carbon fibers, the reinforcing structure being placed inside of the joint body with a distance from the contacting surfaces.

According to one embodiment of the invention the insulating material of the joint body is chosen from the group consisting of:

resin;

epoxy; and plastic.

According to one embodiment of the invention the insulating material of the joint body is a plastic and wherein said plastic is an ultraviolet resistant plastic.

According to one embodiment of the invention the reinforcing structure is embedded into the insulating material of the joint body by a molding process.

According to one embodiment of the invention the joint body is made by pouring the insulating material around the reinforcing structure.

According to one embodiment of the invention the insulating joint further comprises attaching portions configured to be extended along the longitudinal axis for reinforce the fixation of the insulting joint to at least one of the rail sections.

According to one embodiment of the invention the attaching portions are made from the same material as the joint body.

According to one embodiment of the invention the attaching portions are integral with the joint body.

According to one embodiment of the invention the attaching portions comprises a reinforcing structure similar to the reinforcing structure of the joint body.

According to one embodiment of the invention at least one attaching portion is configured to be extended along at least one of the lateral surfaces of at least one of the rail sections, said lateral surface forming a web of said rail section.

According to one embodiment of the invention wherein at least one attaching portion is configured to be extended along at least one of the lateral surfaces of at least one of the rail sections, said lateral surface forming a head surface of said rail section.

According to one embodiment of the invention at least one attaching portion is configured to be extended along at least one of the lateral surfaces of at least one of the rail sections, said lateral surface forming a foot surface of said rail section.

According to one embodiment of the invention at least one attaching portion is configured to be extended along at least one of the lateral surfaces of at least one of the rail sections, said lateral surface forming a bottom surface of said rail section.

According to one embodiment of the invention the insulating joint defines a plane of symmetry.

According to one embodiment of the invention the insulating joint defines an axis of symmetry.

The object of the invention is also to propose a railway track comprising:

at least a pair of adjacent rail sections, each rail section extending along a longitudinal axis and defining at least one connecting surface substantially perpendicular to the longitudinal axis and a plurality of lateral surfaces extending along the longitudinal axis;

an insulating joint for electrically insulating the adjacent rail sections.

The insulating joint comprises a joint body having substantially the same cross section as the rail sections and defining two contacting surfaces, each contacting surface being intended to be in contact with the connecting surface of one of the rail sections;

The joint body is made from an insulating material comprising a reinforcing structure made of metal or carbon fibers, the reinforcing structure being placed inside of the joint body with a distance from the contacting surfaces.

According to one embodiment of the invention the insulating joint is fixed to the corresponding rail sections by a laser welding.

According to one embodiment of the invention the insulating joint is fixed to the corresponding rail sections using an epoxy.

According to one embodiment of the invention the insulating joint is fixed to the corresponding rail sections using a resin.

According to one embodiment of the invention the insulating joint is fixed to the corresponding rail sections so as to form a continuous railway section.

BRIEF DESCRIPTION OF THE DRAWINGS

The aforementioned advantages and features of the present invention will be better understood with reference to the following detailed description and the accompanying drawings in which.

DETAILED DESCRIPTION OF THE INVENTION

Figure 1:
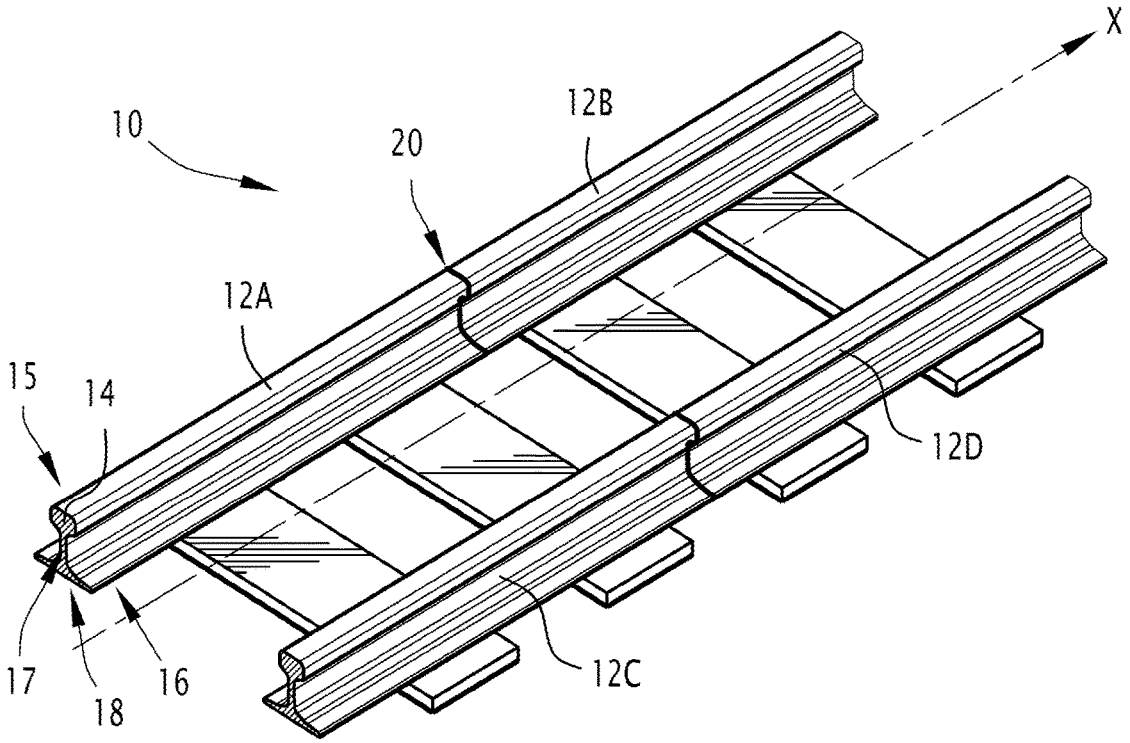
FIG. 1 is a schematic view of a railway track according to the invention, the railway track comprising insulating joints according to the invention.

In the example of FIG. 1, the railway track 10 comprises four railway sections 12A to 12D. The rail sections 12A, 12B are adjacent rail sections as well as the rail sections 12C, 12D. The rail sections 12C, 12D are parallel to the rail sections 12A, 12B and for example, are substantially identical to these sections 12C. 12D. Thus, for simplicity reasons, only the adjacent rail sections 12A, 12B will be detailed afterwards.

Each rail section 12A, 12B extends along a longitudinal axis X and defines one connecting surface at each end of the section and a plurality of lateral surfaces.

Each connecting surface is substantially perpendicular to the longitudinal axis X. On FIG. 1 only one connecting surface 14 of the rail section 12A is visible.

Each lateral surface extends along the longitudinal axis X. According to the terms used in the art, at least one lateral surface of each rail section 12A, 12B forms a head surface 15 corresponding to the top part of rail intended to be in contact with the wheels of a railway vehicle, at least one lateral surface of each rail section 12A, 12B forms a foot surface 16 adjacent to the ground, at least two lateral surfaces of each rail section 12A, 12B forms a web 17 extending between the head and the foot surfaces, and at least one lateral surface of each rail section 12A, 12B forms a bottom surface 18 in contact with the ground.

The web 17 comprises an inner web surface extending on the side of the rail section 12A, 12B, regarding the respective side of the parallel rail section 12C, 12D, and an outer web surface extending on the opposite side of the rail section 12A, 12B.

Each rail section 12A, 12B is used to transmit electrical signals along the railway track 10 between different kinds of installations disposed along the track 10. These electrical signals transport for example numerical data relative to the occupation of a rail section by a railway vehicle.

In order to control the propagation of the electrical signals along the track 10, the adjacent rail sections 12A, 12B are electrically isolated by an insulating joint disposed between these sections and particularly, between the corresponding connecting surfaces of these sections.

Figure 2:
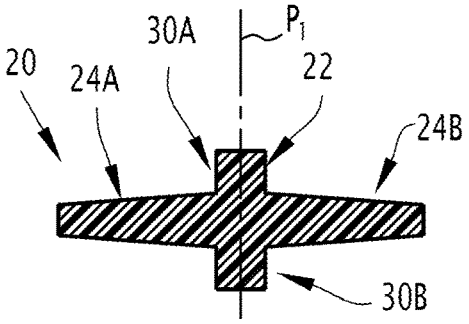
FIGS. 2 and 3 are top and side views of an insulating joint according to a first embodiment of the invention.
Figure 3:
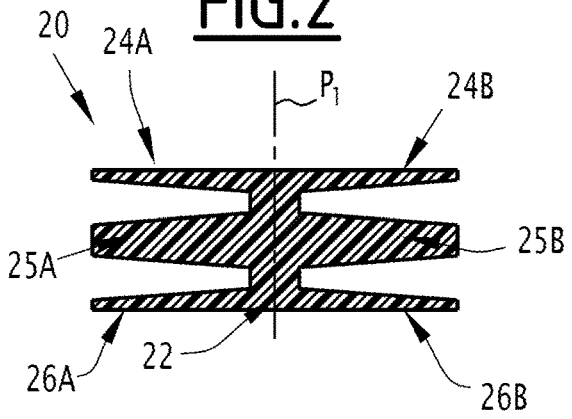

An insulating joint 20 according to a first embodiment of the invention will now be explained in reference to FIGS. 2 and 3 illustrating respectively its top and side views.

Thus, the insulating joint 20 comprises a joint body 22 and a plurality of attaching portions 24A, . . . , 26A and 24B, . . . , 26B.

The joint body 22 has substantially the same cross section as the rail sections 12A, 12B and defines two contacting surfaces 30A, 30B. Each contacting surface 30A, 30B is intended to be in contact with the connecting surface of the corresponding rail section 12A, 12B when the insulating joint is fixed between these rail sections. Thus, in the example of FIGS. 2 and 3, the contacting surface 30A is intended to be in contact with the connecting surface of the rail section 12A and the contacting surface 30B with those of the rail section 12B.

According to the invention, the joint body 22 is made from an insulating material comprising a reinforcing structure made of metal or carbon fibers.

The insulating material is for example a plastic resistant to the ultraviolet emissions. Such plastic is for example chosen from Polytetrafluoroethylene PTFE or Polyvinylidene fluoride PVDF groupings of plastic.

According to another embodiment, the insulating material is a resin or an epoxy.

The reinforcing structure is placed inside of the joint body 22 with a distance from the contacting surfaces. In other word, the reinforcing structure is placed inside of the joint body 22 so as no contact with the corresponding connecting surfaces of the rails sections 12A, 12B appears.

Thus, for example, the reinforcing structure is embedded into the insulating material of the joint body 22 using a molding process. In variant, the insulating material is poured around the reinforcing structure so as to form the joint body 22.

The metal or carbon fibers forming the joint body 22 are arranged according to one or several directions perpendicular to the longitudinal axis X.

According to one example of the invention, the metal or carbon fibers are arranged so as to form a rectangular mesh. In this case, these fibers are arranged according to two directions perpendicular one to the other.

The attaching portions 24A, . . . , 26A, 24B, . . . , 26B are configured to be extended along the longitudinal axis X for reinforcing the fixation of the insulting joint 22 to at least one of the rail sections 12A, 12B.

In particular, each attaching portion 24A, . . . , 26A, 24B, . . . , 26B is configured to be fixed to at least one lateral surface of at least one of the rail sections 12A, 12B.

According to one example of the invention, the attaching portions 24A, . . . , 26A, 24B, . . . , 26B are made from the same material as the joint body 22 and for example are integral with the joint body 22. Consequently, in this case, each attaching portion 24A, . . . , 26A, 24B, . . . , 26B is made from the same insulating material as the joint body 22 which comprises the same reinforcing structure made of metal or carbon fibers. As in the previous case, the reinforcing structure is placed inside of the attaching portions with a distance from the corresponding lateral surface of the corresponding rail section 12A, 12B. Similarly, in this case the whole insulating joint is made using a molding process.

According to another example of the invention, the attaching portions 24A, . . . , 26A, 24B, . . . , 26B are made from a different material than the joint body 22. In this case, this material differs from the material of the joint body 22 by its insulating and/or reinforcing component. According to one example, the material of the attaching portions 24A, . . . , 26A, 24B, . . . , 26B comprises only an insulating component or only a reinforcing component.

According to the embodiment of FIGS. 2 and 3, the attaching portions 24A, . . . , 26A, 24B, . . . , 26B are arranged on both sides of the joint body 22 so as to form a symmetric piece in respect of a plane of symmetry $P_1$. This plane of symmetry $P_1$ crosses for example the joint body 22 between the contacting surfaces 30A, 30B.

Thus, as it is illustrated on these figures, the attaching portions 24A, . . . , 26A extend from the contacting surface 30A and are configured to fix the insulating joint 20 to the rail section 12A. The attaching portions 24B, . . . , 26B extend from the contacting surface 30B symmetrically to the attaching portion 24A, . . . , 26A and are configured to fix the insulating joint 20 to the rail section 12B.

Figure 4:
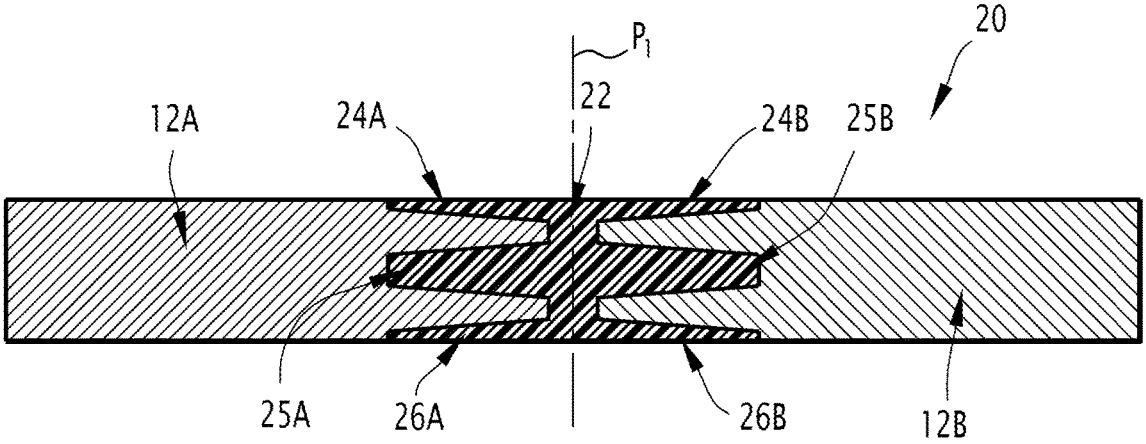
FIG. 4 is a side view of the insulating joint of FIGS. 2 and 3 fixed to the railway track of FIG. 1.

A side view of the insulating joint 20 fixed between the rail sections 12A, 12B is illustrated on FIG. 4.

Thus, as it can be seen on this figure, the attaching portions 24A, 25A and 26A extend respectively along the head surface, the web and the bottom surface of the rail section 12A. The attaching portions 24B, 25B and 26B extend respectively along the head surface, the web and the bottom surface of the rail section 12B.

According to one example of the invention, each of the attaching portions 25A, 25B presents two parallel parts intended to be fixed to the inner web surface and to the outer web surface of the corresponding rail sections 12A, 12B.

According to another example of the invention, each of the attaching portions 25A, 25B presents only one part intended to be fixed either to the inner web surface, either to the outer web surface.

Each attaching portion 24A, . . . , 26A, 24B, . . . , 26B is fixed to the corresponding lateral surface of the corresponding rail section 12A, 12B by a laser welding using for example a LAMP process known in the art. Advantageously, an extremity of each attaching portions disposed on the opposite of the joint body is fixed by a laser welding to the rail section cooperating with the corresponding attaching portion.

Advantageously, the contacting surfaces 30A, 30B are fixed by a laser welding to the rail section cooperating with them.

According to another embodiment of the invention, each attaching portion 24A, . . . , 26A, 24B, . . . , 26B is fixed to the corresponding lateral surface of the corresponding rail section 12A, 12B using a resin or an epoxy.

Finally, the attaching portions 24A, . . . , 26A, 24B, . . . , 26B and particularly, the attaching portions 24A, 24B are fixed to the corresponding lateral surfaces of the corresponding rail sections 12A, 12B so as to form a continuous rail section, particularly on the head surfaces. The thickness of each attaching portion 24A, . . . , 26A, 24B, . . . , 26B and/or of the ends of the corresponding rail sections 12A, 12B is adapted accordingly.

The other embodiments of the insulating joint disclosed below differ from the insulating joint 20 of FIGS. 2 and 3, only by the number and disposition of the attaching portions.

Figure 5:
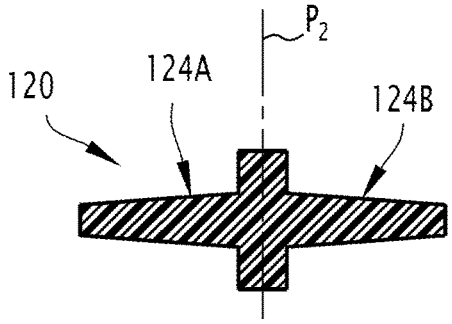
FIGS. 5 and 6 are top and side views of an insulating joint according to a second embodiment of the invention.
Figure 6:
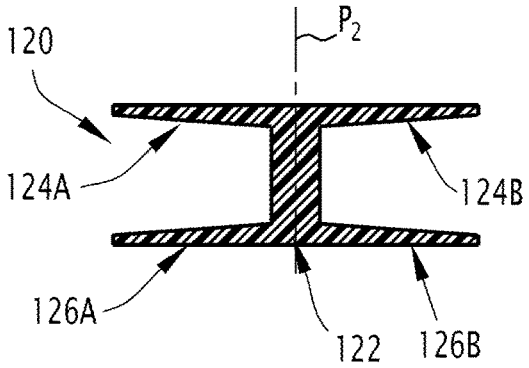

FIGS. 5 and 6 illustrate a top and a side views of an insulating joint 120 according to a second embodiment of the invention.

The insulating joint 120 comprises a joint body 122 similar to the joint body 22 detailed above and only attaching portions 124A, 124B and 126A, 126B.

The attaching portions 124A, 124B are similar to the attaching portions 24A, 24B detailed above. Thus, the attaching portions 124A, 124B are intended to be fixed to the head surfaces respectively of the rail sections 12A and 12B.

The attaching portions 126A, 126B are similar to the attaching portions 26A, 26B detailed above. Thus, the attaching portions 126A, 126B are intended to be fixed to the bottom surfaces respectively of the rail sections 12A and 12B.

Like in the previous case, the insulating joint 120 is symmetrical in respect of a plane of symmetry $P_2$ comprised between two contacting surfaces of the joint body 122.

Figure 7:
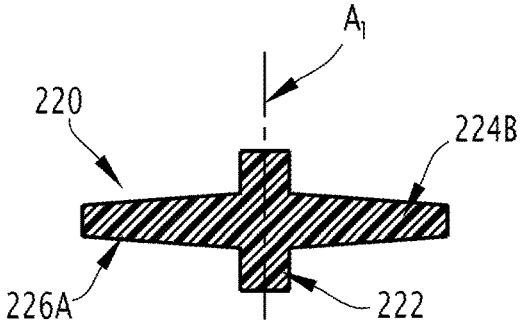
FIGS. 7 and 8 are top and side views of an insulating joint according to a third embodiment of the invention.
Figure 8:
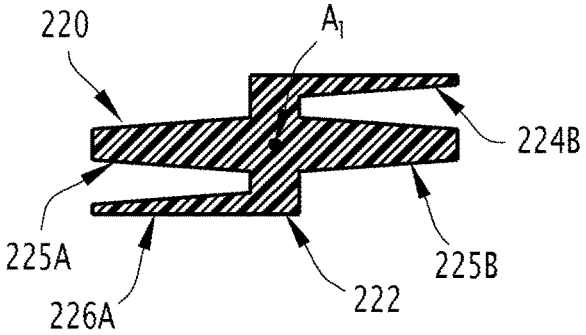

FIGS. 7 and 8 illustrate a top and a side views of an insulating joint 220 according to a third embodiment of the invention.

The insulating joint 220 comprises a joint body 222 similar to the joint body 22 detailed above and only attaching portions 224B, 226A and 225A, 225B.

The attaching portions 225A, 225B are similar to the attaching portions 25A, 25B detailed above. Thus, the attaching portions 225A, 225B are intended to be fixed to the web respectively of the rail sections 12A and 12B.

The attaching portions 224B is similar to the attaching portion 24B detailed above and is intended to be fixed to the head surface of the rail section 12B.

The attaching portions 226A is similar to the attaching portion 26A detailed above and is intended to be fixed to the bottom surface of the rail section 12B.

The insulating joint 220 is symmetrical in respect of an axis of symmetry $A_1$ parallel to the contacting surfaces of the joint body 222 and perpendicular to the plane of FIG. 8.

Figure 9:
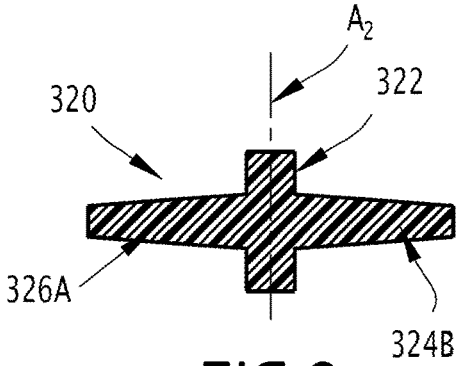
FIGS. 9 and 10 are top and side views of an insulating joint according to a fourth embodiment of the invention.
Figure 10:
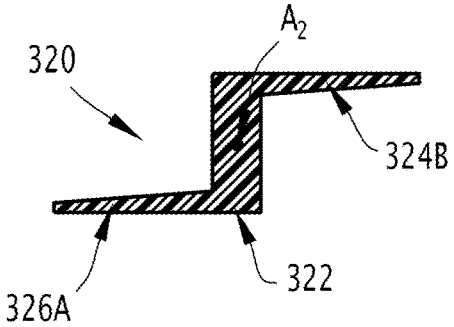

FIGS. 9 and 10 illustrate a top and a side views of an insulating joint 320 according to a fourth embodiment of the invention.

The insulating joint 320 comprises a joint body 322 similar to the joint body 22 detailed above and only attaching portions 324B and 326A.

The attaching portions 324B is similar to the attaching portion 24B detailed above and is intended to be fixed to the head surface of the rail section 12B.

The attaching portions 326A is similar to the attaching portion 26A detailed above and is intended to be fixed to the bottom surface of the rail section 12B.

Like in the previous case, the insulating joint 320 is symmetrical in respect of an axis of symmetry $A_2$ parallel to the contacting surfaces of the joint body 322 and perpendicular to the plane of FIG. 10.

The insulating joint and the railway track according to the invention present a number of advantages.

First of all, the insulating joint according to the invention is made from a resistant material having a life cycle comparable with those of the rails. So, the replacement of such insulating joint is less frequent than those of a classical joint made from polyurethane. Consequently, the cost of maintenance of a railway tack equipped with such insulating joints is reduced.

Moreover, the fixation of the insulating joint to the rail section is considerably improved using several attaching portions extending along at least one lateral portion of the rail sections. This also makes it possible to extend the life cycle of such joint and to reduce considerable the maintenance cost of railway track comprising such joints.

Alternatively, the insulating joint comprises at least one attaching portion configured to be extended along at least one of the lateral surfaces of at least one of the rail sections, said lateral surface forming a foot surface of said rail section.

Moreover, the insulated joint is fixed using lateral surfaces of the corresponding rail sections. This makes it possible to absorb a part of the bump between these rail sections by the attaching portions and thus, creates less wear in the joint body in comparison with the joint body of a conventional insulated joint.

Finally, the production process of the insulating joint by molding is particularly simple and relatively cheap.

The invention claimed is:

1. An insulating joint for electrically insulating a pair of adjacent rail sections of a railway track, each rail section extending along a longitudinal axis and defining at least one connecting surface substantially perpendicular to the longitudinal axis and a plurality of lateral surfaces extending along the longitudinal axis;

the insulating joint comprising a joint body having substantially the same cross section as the rail sections and defining two contacting surfaces, each contacting surface being intended to be in contact with the connecting surface of one of the rail sections, wherein the insulating joint further comprises attaching portions configured to be extended along the longitudinal axis for reinforcing the fixation of the insulting joint to at least one of the rail sections;

wherein the joint body is made from an insulating material comprising a reinforcing structure made of metal or carbon fibers, the reinforcing structure being placed inside of the joint body with a distance from the contacting surfaces.

2. The insulating joint according to claim 1, wherein the insulating material of the joint body is chosen from the group consisting of:

resin;

epoxy; and plastic.

3. The insulating joint according to claim 1, wherein the insulating material of the joint body is a plastic and wherein said plastic is an ultraviolet resistant plastic.

4. The insulating joint according to claim 1, wherein the reinforcing structure is embedded into the insulating material of the joint body by a molding process.

5. The insulating joint according to claim 1, wherein the joint body is made by pouring the insulating material around the reinforcing structure.

6. The insulating joint according to claim 1, wherein the attaching portions are made from the same material as the joint body.

7. The insulating joint according to claim 1, wherein the attaching portions are integral with the joint body.

8. The insulating joint according to claim 1, wherein the attaching portions comprise a reinforcing structure similar to the reinforcing structure of the joint body.

9. The insulating joint according to claim 1, wherein at least one attaching portion is configured to be extended along at least one of the lateral surfaces of at least one of the rail sections, said lateral surface forming a web of said rail section.

10. The insulating joint according to claim 1, wherein at least one attaching portion is configured to be extended along at least one of the lateral surfaces of at least one of the rail sections, said lateral surface forming a head surface of said rail section.

11. The insulating joint according to claim 1, wherein at least one attaching portion is configured to be extended along at least one of the lateral surfaces of at least one of the rail sections, said lateral surface forming a foot surface of said rail section.

12. The insulating joint according to claim 1, wherein at least one attaching portion is configured to be extended along at least one of the lateral surfaces of at least one of the rail sections, said lateral surface forming a bottom surface of said rail section.

13. The insulating joint according to claim 1, defining a plane of symmetry.

14. The insulating joint according to claim 1, defining an axis of symmetry.

15. A railway track comprising:

at least a pair of adjacent rail sections, each rail section extending along a longitudinal axis and defining at least one connecting surface substantially perpendicular to the longitudinal axis and a plurality of lateral surfaces extending along the longitudinal axis;

an insulating joint for electrically insulating the adjacent rail sections;

wherein the insulating joint comprises a joint body having substantially the same cross section as the rail sections and defining two contacting surfaces, each contacting surface being intended to be in contact with the connecting surface of one of the rail sections, and wherein the insulating joint further comprises attaching portions configured to be extended along the longitudinal axis for reinforcing the fixation of the insulting joint to at least one of the rail sections;

wherein the joint body is made from an insulating material comprising a reinforcing structure made of metal or carbon fibers, the reinforcing structure being placed inside of the joint body with a distance from the contacting surfaces.

16. The railway track according to claim 15, wherein the insulating joint is fixed to the corresponding rail sections by a laser welding.

17. The railway track according to claim 15, wherein the insulating joint is fixed to the corresponding rail sections using an epoxy.

18. The railway track according to claim 15, wherein the insulating joint is fixed to the corresponding rail sections using a resin.

19. The railway track according to claim 15, wherein the insulating joint is fixed to the corresponding rail sections so as to form a continuous railway section.

* * * * *